US006783416B2

(12) United States Patent
Lee et al.

(10) Patent No.: US 6,783,416 B2
(45) Date of Patent: Aug. 31, 2004

(54) PLASMA DISPLAY PANEL AND METHOD OF FABRICATING BARRIER RIB THEREOF

(75) Inventors: Yoon Kwan Lee, Kyunggi-do (KR); Soo Je Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/318,206

(22) Filed: Dec. 13, 2002

(65) Prior Publication Data

US 2003/0090207 A1 May 15, 2003

Related U.S. Application Data

(62) Division of application No. 09/357,127, filed on Jul. 20, 1999, now Pat. No. 6,508,685.

(30) Foreign Application Priority Data

Jul. 21, 1998 (KR) ..... 98-29333

(51) Int. Cl.[7] ..... H01J 9/24
(52) U.S. Cl. ..... 445/24; 445/23
(58) Field of Search ..... 445/24, 25, 38, 445/23; 427/428; 205/80, 70; 313/582–587

(56) References Cited

U.S. PATENT DOCUMENTS

| | | | | |
|---|---|---|---|---|
| 5,853,446 A | * | 12/1998 | Carre et al. | 427/428 |
| 5,982,095 A | | 11/1999 | Jin et al. | 313/582 |
| 5,993,723 A | * | 11/1999 | Tanaka et al. | 264/500 |
| 6,184,621 B1 | * | 2/2001 | Horiuchi et al. | 445/24 |
| 6,232,716 B1 | | 5/2001 | Ok et al. | 313/582 |

FOREIGN PATENT DOCUMENTS

| | | |
|---|---|---|
| JP | 06-223725 | 8/1994 |
| JP | 06-295675 | 10/1994 |
| JP | 06-310038 | 11/1994 |
| JP | 09-171769 | 6/1997 |
| JP | 11-061486 | 3/1999 |

* cited by examiner

*Primary Examiner*—Joseph Williams
(74) *Attorney, Agent, or Firm*—Fleshner & Kim, LLP

(57) ABSTRACT

A plasma display panel including a barrier rib for separating a discharge space thereof into a discharge cell unit and a method of fabricating the barrier rib. The barrier rib is formed by utilizing an electro plating technique. Accordingly, it is possible to shield electrical and optical interference between discharge cells and to improve the radiation efficiency. The barrier rib fabricating method is so simple that it can obtain an improvement of the productivity and a reduction of the manufacturing cost.

20 Claims, 8 Drawing Sheets

PLASMA DISPLAY PANEL AND METHOD OF FABRICATING BARRIER RIB THEREOF

This is a Divisional of Ser. No. 09/357,127 filed on Jul. 20, 1999, now U.S. Pat. No. 6,508,685.

BACKGROUND OF THE INVENTION

1. Field of the Invention

This invention relates to a flat panel display device, and more particularly to a plasma display panel (PDP) provided with a barrier rib which can separate a discharge space of the PDP exploiting a gas charge into the discharge cell unit. Also, this invention is directed to a process of fabricating the barrier rib of the PDP.

2. Description of the Prior Art

Nowadays, there have been actively developed a flat panel display device such as a liquid crystal display (LCD), a field emission display (FED), a plasma display panel (PDP) and so on. In the flat panel display device, the PDP has advantages in that it provides an easiness for a manufacture of large-scale screen due to its simple structure, and that it has a light view angle more than 160° and characteristics of lack thickness and light weight. The PDP exploits a gas discharge phenomenon to display a picture by radiating a fluorescent body of vacuum ultraviolet ray generating during a gas discharge. A typical structure of the PDP will be described with reference to FIG. 1 below.

FIG. 1 shows a structure of a discharge cell arranged in a matrix pattern in the conventional PDP. The PDP discharge cell includes an upper plate having a sustaining electrode pair 12A and 12B, an upper dielectric layer 14 and a protective film 16 that are sequentially formed on an upper substrate 10, and a lower plate having an address electrode 20, a lower dielectric layer 22, a barrier rib 24 and a fluorescent body layer that are sequentially formed on a lower substrate 18. The upper substrate 10 is spaced in parallel from the lower substrate 18 by the barrier rib 24. The sustaining electrode pair included in the upper plate consists of a scanning/sustaining electrode 12A and a sustaining electrode 12B. The scanning/sustaining electrode 12A is responsible for applying a scanning signal for an address discharge and a sustaining signal for a sustained discharge, etc. On the other hand, the sustaining electrode 12B is responsible for applying a sustaining signal for a sustained discharge, etc. The upper dielectric layer 14 is formed on the upper substrate 10 on which the sustaining electrode pair 12A and 12B is provided, thereby accumulating an electric charge. The protective film 16 is coated on the surface of the upper dielectric layer 14. A MgO film is usually used as the protective film 16. The protective film 16 protects the upper dielectric layer 14 from the sputtering phenomenon of plasma articles so that it may prolong a life of PDP and improve an emission efficiency of secondary electrons. Also, the protective film 16 reduces a variation in the discharge characteristic of a refractory metal due to a contamination of oxide. The address electrode 20 included in the lower plate is formed on the lower substrate 18 in such a manner to be crossed with the sustaining electrode pair 12A and 12B. The address electrode 20 serves to apply a data signal for the address discharge. The lower dielectric layer 22 is formed on the lower substrate 18 on which the address electrode 20 is provided. The barrier rib 24 is arranged in parallel to the address electrode 20 on the lower dielectric layer 22. The barrier rib 24 serves to provide a stripe-type discharge space at the inner side of the discharge cell so as to shield electrical and optical interference between the adjacent discharge cells. Also, the barrier rib 24 serves to support the upper substrate 10 and the lower substrate 18. The fluorescent body layer 26 is coated on the surfaces of the lower dielectric layer 22 and the barrier rib 24 to generate a red, green, or blue visible ray. Further, an inactive gas for the gas discharge is sealed into the discharge space. The PDP discharge cell having a structure as described above maintains a discharge by a face discharge between the sustaining electrode pair 12A and 12B after being selected by an opposite discharge between the address electrode 20 and the scanning/sustaining electrode 12A. In the PDP discharge cell, the fluorescent body 26 is radiated by an ultraviolet ray generated during the sustained discharge, thereby emitting a visible light to the outer side of the discharge cell. As a result, the PDP with the discharge cells displays a picture.

FIG. 2 shows a PDP device including the discharge cell shown in FIG. 1. Referring to FIG. 2, the barrier rib 24 plays an important role of providing a stripe-type discharge space to prevent electrical and optical interference between the adjacent discharge spaces. In this case, the conventional barrier rib 24 has a width of about 100 $\mu$m and a height of about 200 $\mu$m, and it is mainly made from a ceramic or a glass-ceramics. However, the conventional stripe-type barrier rib 24 has a problem in that, since it separates the discharge space only into the column line unit without separating the same into the row line unit, it fails to shield electrical and optical interference between the row lines. In other words, in the conventional barrier rib 24 cannot shut out electrical and optical interference between the picture elements because a discharge space is not separated for each picture element. Further, a PDP device including the conventional stripe-type barrier rib 24 has a drawback in that it has a relatively low radiation efficiency because it utilizes only the fluorescent body layer 26 coated on each face of the barrier rib 24 and the surface of the lower dielectric layer 22.

In addition, the conventional barrier rib 24 is formed by exploiting the screen printing technique, the sand blast technique, the additive technique or the like. However, such methods of fabricating the barrier rib have basic problems in that a fabrication process is complicated and a large amount of materials are wasted.

FIG. 3*a* to FIG. 3*d* are sectional views for representing a process of fabricating the barrier rib making use of the screen printing technique step by step. Referring now to FIG. 3*a*, there is shown a structure in which the lower dielectric layer 22 and the glass paste patterns 28 are disposed on the lower substrate 18 in turn. The glass paste patterns 28 are formed by coating a glass paste prepared by mixing glass powder, which is mixed by the parent glass and the filler, with an organic vehicle on the lower dielectric layer 22 at a desired thickness using the screen printing technique and thereafter by drying the same during a desired time. Then, a process of forming the glass paste patterns 28 as mentioned above is repeatedly performed about seven to eight times as shown in FIG. 3*b* and FIG. 3*c*. As a result, the glass paste patterns 28 are disposed into a desired height, for example, of 150 to 200 $\mu$m. The glass paste patterns 28 disposed in this manner are calcined to provide the barrier ribs 24 having a desired height on the lower dielectric layer 22 as shown in FIG. 3*d*.

Such a screen printing method has an advantage in that the process is simple and the fabrication cost is low. However, the screen printing method has a problem in that a lot of time is required because it needs procedures for performing a position adjustment of the screen and the lower substrate 18 and for repeating the printing and the drying several times. In addition, the screen printing method is not suitable for the fabrication of a barrier rib for a high resolution PDP because a position between the screen and the lower substrate go amiss during the repeated work.

FIG. 4*a* to FIG. 4*f* are sectional views for representing a process of fabricating the barrier rib making use of the sand blast technique. After a glass paste 30 is coated on the lower dielectric layer 22 formed on the lower substrate 18 as shown in FIG. 4*a*, a photo resistor 32 is coated on the glass paste 30 as shown in FIG. 4*b*. Next, as shown in FIG. 4*c*, mask patterns 34 are positioned on the photo resistor 32 which is exposed to a light through openings of the mask patterns 34 in turn. Subsequently, after the mask patterns 34 are removed, a non-exposed portion of the photo resistor 32 is removed to form photo resistor patterns 32A as shown in FIG. 4*d*. Then, glass paste patterns 30A are formed in the same shape as the photo resister patterns 32A as shown in FIG. 4*e* by removing the exposed glass paste 30 through the photo resistor patterns 32A using the sand blast technique. Consequently, the barrier ribs 24 are provided on the lower dielectric layer 22 as shown in FIG. 4*f* by calcining the glass paste patterns 30A after removing the photo resistor patterns 32A.

Such a sand blast method has an advantage in that the formation of fine barrier ribs is possible and it is suitable for manufacturing a large dimension of substrate. However, the sand blast method has problems in that a lot of cost is required for the facilities investment, that the fabrication process is complicated, and that a lot of materials are wasted. Also, the sand blast method gives rise to a crack of the substrate at the time of calcining because physical impact is applied to the substrate by the sand blast.

FIG. 5*a* to FIG. 5*e* are sectional views for representing a process of fabricating the barrier rib making use of the additive technique step by step. As shown in FIG. 5*a*, a photo resistor 38 is coated on the lower dielectric layer 22 disposed on the lower substrate 18. Then, as shown in FIG. 5*b*, mask patterns 40 are positioned on the photo resistor 38 which is exposed to a light through the mask patterns 40. Subsequently, the mask patterns 40 are removed and then the exposed portion of the photo resistor 38 is removed to thereby form photo resistor patterns 38A as shown in FIG. 5*c*. Next, as shown in FIG. 5*d*, glass pastes 30 are coated between the photo resistor patterns 38A and then dried. Consequently, the barrier ribs 24 are provided on the lower dielectric layer 22 as shown in FIG. 6*e* by removing the photo resistor patterns 38A and thereafter by calcining the glass paste 30.

Such an additive method has an advantage in that the formation of fine barrier ribs is possible and it is suitable for manufacturing a large dimension of substrate. However, the additive method has problems in that, when the glass paste 40 having a height of more than 100 $\mu$m is coated, a lot of fabrication time is required, and the coated glass paste 40 is collapsed or a crack is generated at the barrier ribs 24 at the time of calcining. Also, the additive method requires the development of a technique that can cleanly eliminate a sensitive film remained after the calcining.

SUMMARY OF THE INVENTION

Accordingly, it is an object of the present invention to provide a fabrication for forming barrier ribs for a plasma display panel (PDP), which is solve the problems as described above of the prior art.

Another object of the present invention is to provide a plasma display panel (PDP) wherein it includes a barrier rib with a lattice structure to separate a discharge space for each picture element, thereby shielding electrical and optical interference.

Still another object of the present invention is to provide a PDP wherein it includes a barrier rib with a lattice structure to increase a coated area of a fluorescent body layer, thereby improving the radiation efficiency of the PDP device.

Still another object of the present invention is to provide a PDP wherein it uses a barrier rib as a sustaining electrode to reduce the number of construction elements of an upper plate, thereby improving a transmitted light amount.

Still another object of the present invention is to provide a mold for fabricating a barrier rib that is adaptive for the fabrication of a barrier rib with a lattice structure.

Still another object of the present invention is to provide a method of fabricating a barrier rib for a PDP wherein a barrier rib is formed by means of the electro plating, thereby simplifying a fabrication process of the PDP barrier rib.

In order to achieve these and other objects of the invention, a plasma display panel according to one aspect of the present invention includes a first electrode for applying a scanning signal and a sustaining signal; a second electrode for applying a image data signal; a first substrate at which the first electrode is defined; a second substrate at which the second electrode is defined; and a barrier rib, being formed between the first substrate and the second substrate, for providing a discharge space closed on all sides.

A mold for fabricating a barrier rib in a plasma display panel according to another aspect of the present invention includes a body having a plating solution inlet formed on one side thereof; and a pattern formed on other side of the body to form the barrier rib.

A method of fabricating a barrier rib in a plasma display panel according to still another aspect of the present invention has the step of forming a metal barrier rib by using an electric plating technique.

Further, a method of fabricating a barrier rib in a plasma display panel according to still another aspect of the present invention includes the steps of forming a metal seed layer on a first substrate; attaching a barrier rib fabricating mold prepared separately onto the metal seed layer; filling the mold with a plating liquid using an electric plating technique to form the barrier rib; and separating the mold from the barrier rib and removing the exposed metal seed layer.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
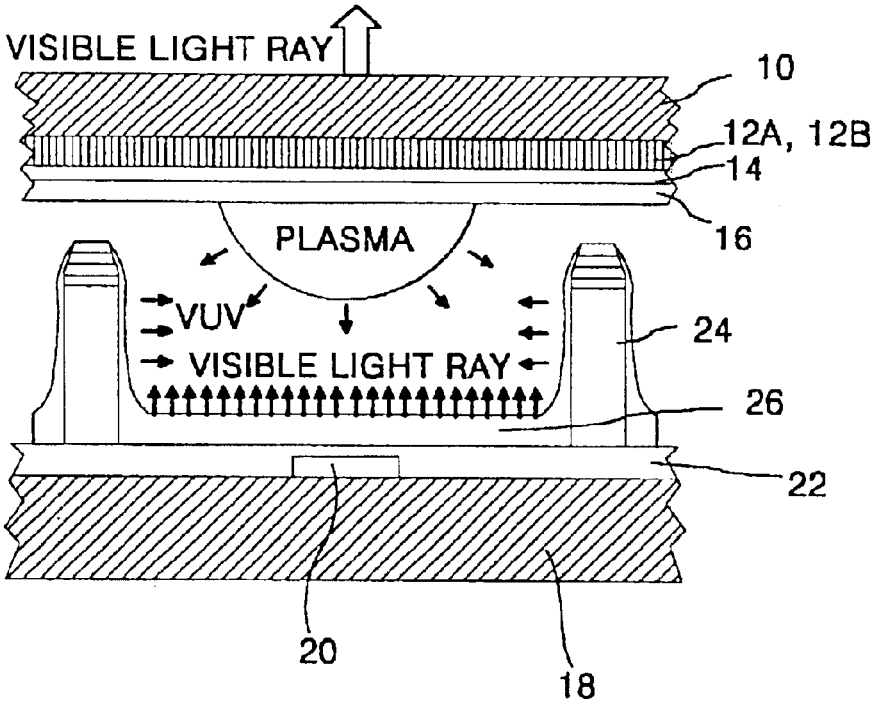
FIG.1 RELATED ART
FIG. 1 is a sectional view showing the structure of a discharge cell in the conventional plasma display panel.
Figure 2:
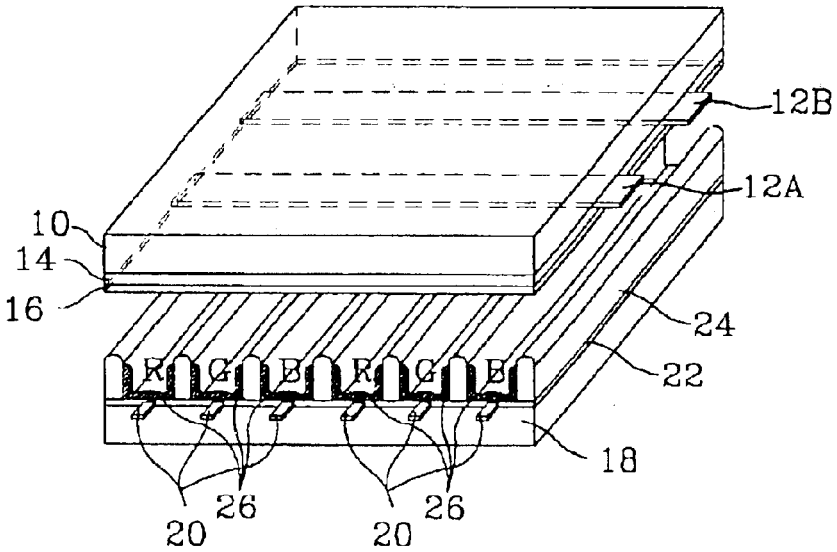
FIG.2 RELATED ART
FIG. 2 is a perspective view showing the structure of the PDP including the discharge cell in FIG. 1.
Figure 3A:
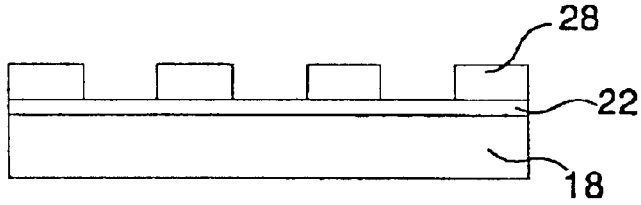
FIG.3a RELATED ART
FIG. 3*a* and FIG. 3*d* are sectional views showing a method of fabricating barrier ribs using the screen printing technique step by step.
Figure 3B:
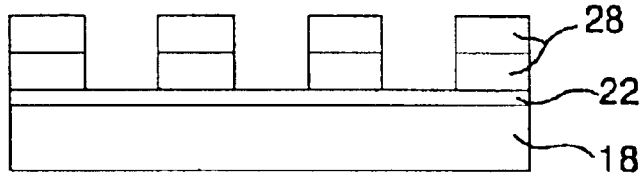
FIG.3b RELATED ART
Figure 3C:
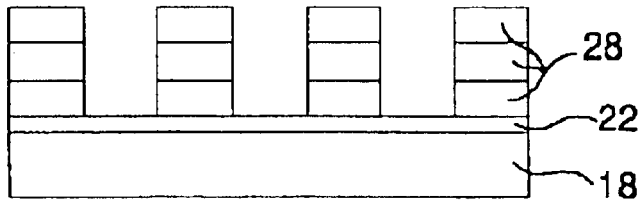
FIG.3c RELATED ART
Figure 3D:
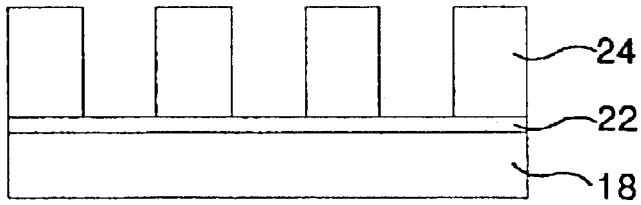
FIG.3d RELATED ART
Figure 4A:
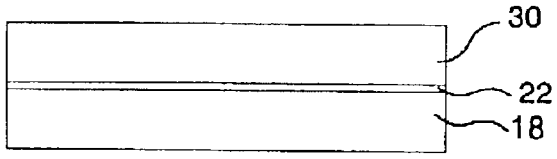
FIG. 4a RELATED ART
FIG. 4*a* and FIG. 4*f* are sectional views showing a method of fabricating barrier ribs using the sand blast technique step by step.
Figure 4B:
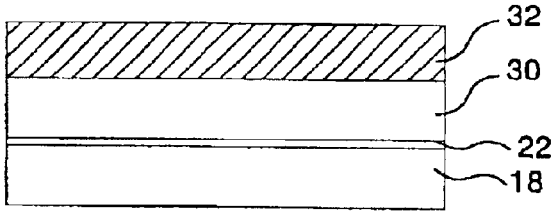
FIG. 4b RELATED ART
Figure 4C:
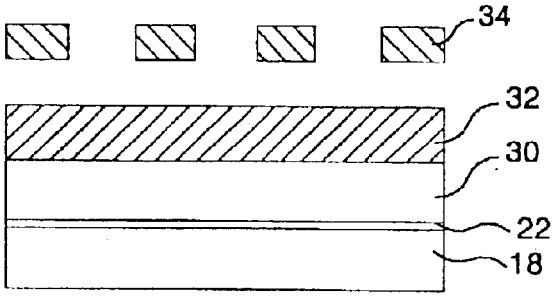
FIG. 4c RELATED ART
Figure 4D:
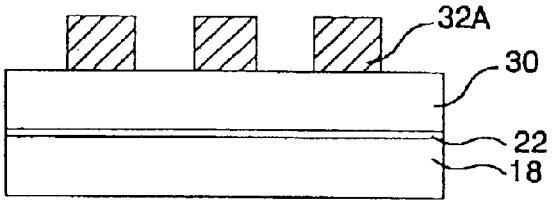
FIG. 4d RELATED ART
Figure 4E:
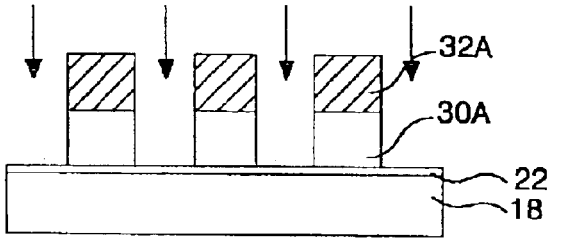
FIG. 4e RELATED ART
Figure 4F:
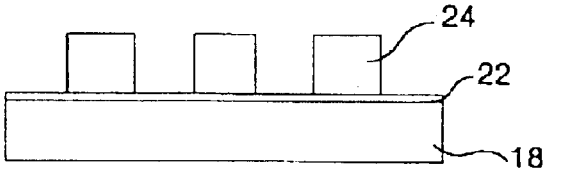
FIG. 4f RELATED ART
Figure 5A:
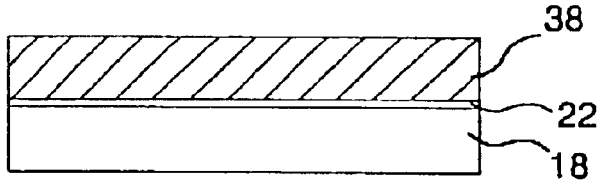
FIG.5a RELATED ART
FIG. 5*a* and FIG. 5*e* are sectional views showing a method of fabricating barrier ribs using the additive technique step by step.
Figure 5B:
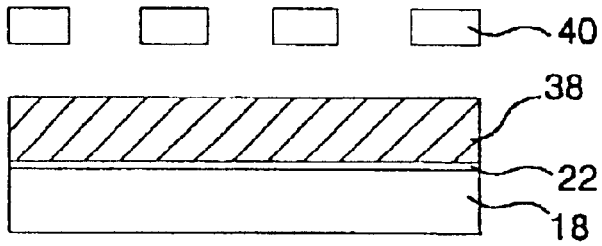
FIG.5b RELATED ART
Figure 5C:
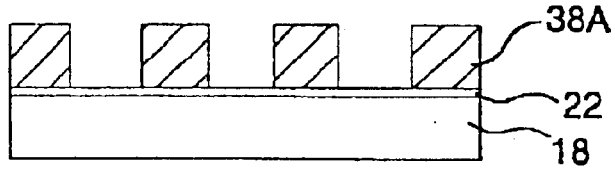
FIG.5c RELATED ART
Figure 5D:
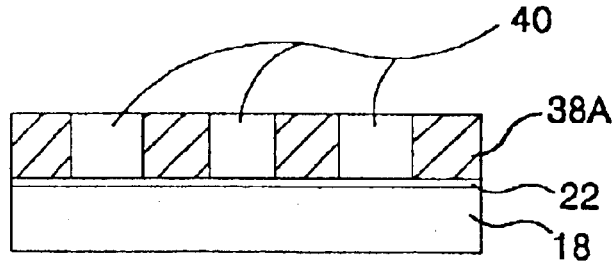
FIG.5d RELATED ART
Figure 5E:
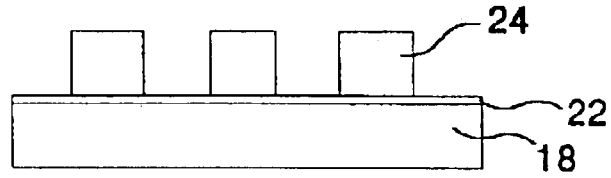
FIG.5e RELATED ART
Figure 6:
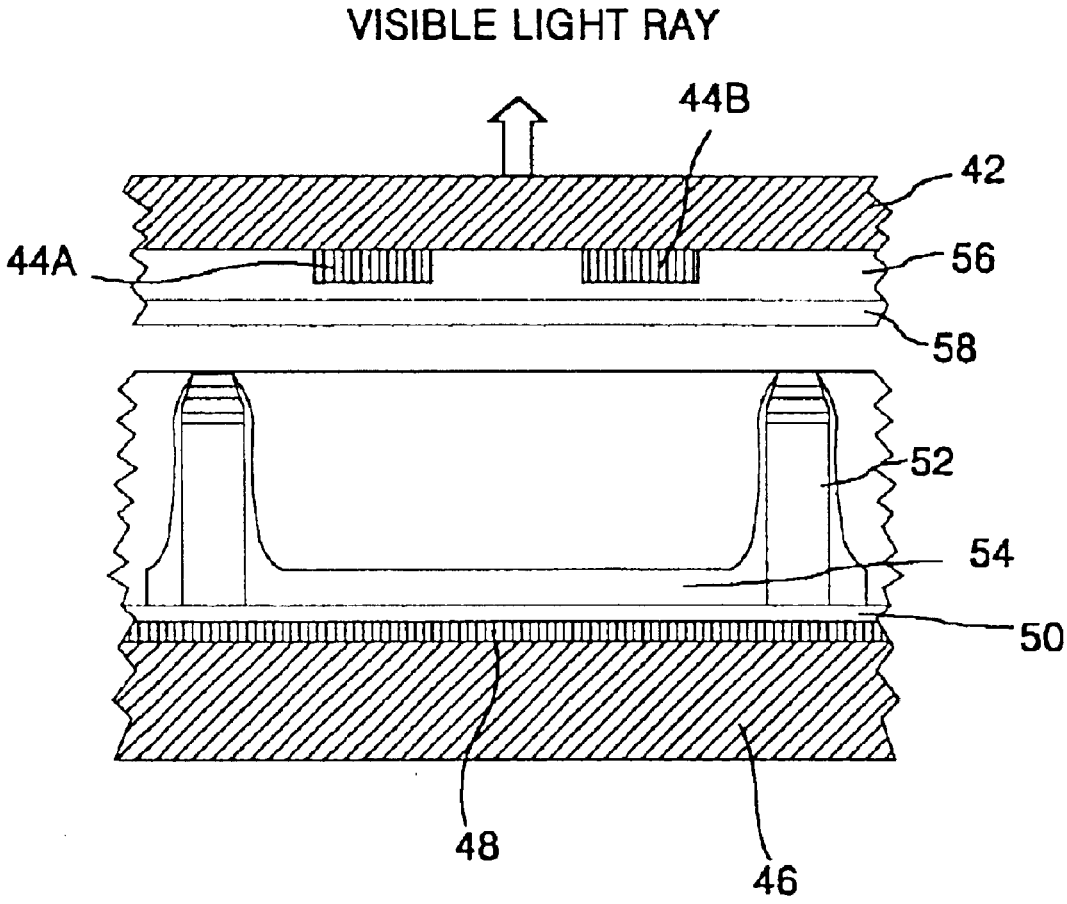
FIG. 6 is a sectional view showing the structure of a discharge cell for a PDP according to an embodiment of the present invention.

Referring to FIG. 6, there is shown a discharge cell for a PDP according to an embodiment of the present invention. The PDP discharge cell includes an upper substrate 42 provided with a sustaining electrode pair 44A and 44B, and a lower substrate 46 provided with an address electrode 48 and a barrier rib 52 with a lattice structure.

The sustaining electrode pair 44A and 44B included in the upper plate consists of a scanning/sustaining electrode 44A and a sustaining electrode 44B. The scanning/sustaining electrode 44A is responsible for applying a scanning signal for an address discharge and a sustaining signal for a sustained discharge, etc. On the other hand, the sustaining electrode 44B is responsible for applying a sustaining signal for a sustained discharge, etc. The upper dielectric layer 56 is formed on the upper substrate 42 on which the sustaining electrode pair 44A and 44B is provided, thereby accumulating an electric charge. The protective film 58 is coated on the surface of the upper dielectric layer 56. As a material of the protective film 58 is used MgO, BaO, CaO, and diamond-like carbon (DLC), etc. The address electrode 48 is formed on the lower substrate 46 in such a manner to be crossed with the sustaining electrode pair 44A and 44B. The address electrode 48 serves to apply a data signal for the address discharge. The lower dielectric layer 50 is formed on the lower substrate 46 on which the address electrode 48 is provided. The barrier rib 52 is defined on the lower dielectric layer 50 in a lattice structure to provide a discharge space for each picture element. Such a barrier rib 52 is made from a material such as Cu, Ni, Ag and Cr, etc. or their alloy, or other appropriate metal material and formed by an electro plating employing a mold. Accordingly, the barrier rib 52 serves to increase the reflectivity of a visible light. The fluorescent body layer 54 is formed at the barrier rib 52 and the surface of the lower dielectric layer 50. The fluorescent body layer 54 is formed at the barrier rib 52 and the surface of the lower dielectric layer 50 by means of the chemical vapor deposition, the physical-chemical vapor deposition (PECVD), the screen printing technique, the high temperature oxide film treatment technique and the sol-gel method, etc. Herein, sol-gel method is to form a thin film on a main body with a complicated shape at a low temperature and which has a characteristic of relatively simple process. Further, an inactive gas for the gas discharge is sealed into the discharge space. The PDP discharge cell having a structure as described above is selected by a sustained discharge between the address electrode 48 and the scanning/sustaining electrode 44A and thereafter keeps a discharge by the sustained discharge between the scanning/sustaining electrode 44A and the sustaining electrode 44B and then by radiating the fluorescent body 56 by an ultraviolet generated during the sustained discharge to emit a visible light, thereby displaying a picture.

In the PDP according to the present invention including such a structure of discharge cell, the fluorescent body layer 54 is coated on the barrier rib 52 with a lattice structure and the lower dielectric layer 50, whereby its coated area is increased compared with the prior art to improve a radiation efficiency.

Meanwhile, if the barrier rib 52 is formed in a shape of stripe instead of the lattice structure, the barrier rib 52 can be used as the sustaining electrode 44A. In this case, the scanning/sustaining electrode 44A only is formed on the upper substrate 42 to be simplified compared with the conventional upper plate, so that a transmitted light amount can be increased to improve a radiation efficiency. Also, in the PDP according to the present invention, Referring now to FIG. 7, there is shown the structure of a lower plate in a PDP according to an embodiment of the present invention in which a barrier rib 52 with a lattice shape is formed on a lower substrate 46. It can be seen from FIG. 7 that a discharge space is separated into the pixel unit by the lattice shape of barrier rib 52. Otherwise, the barrier rib 52 may be formed in a bee haive shape or other appropriate shape. Electrical and optical interference between the picture elements can be shielded by such a shape of barrier rib 52. For example, the discharge space is separated for each picture element to prevent an ultraviolet generated by a discharge at a discharge space in a certain picture element from making an effect to a fluorescent body in other picture element as well as to allow a visible light generated at the fluorescent body by a radiation from the ultraviolet to be emitted from only a desired picture element. Also, the barrier rib 52 with a lattice shape can be formed to have a width of less than 100 $\mu$m by means of the electro plating employing a mold, thereby enlarging the discharge space.

Figure 7:
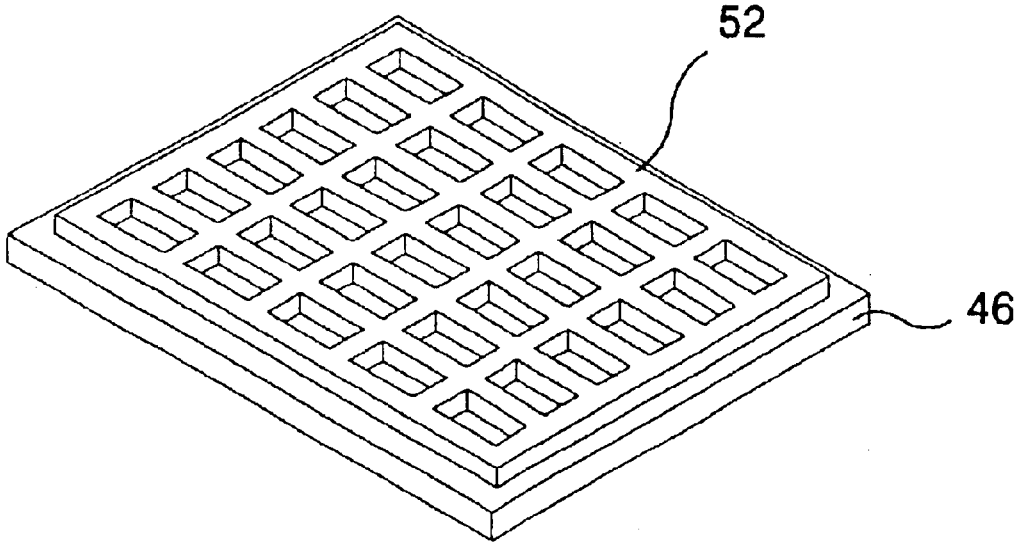
FIG. 7 is a perspective view showing the shape of the barrier rib in FIG. 6.
Figure 8A:
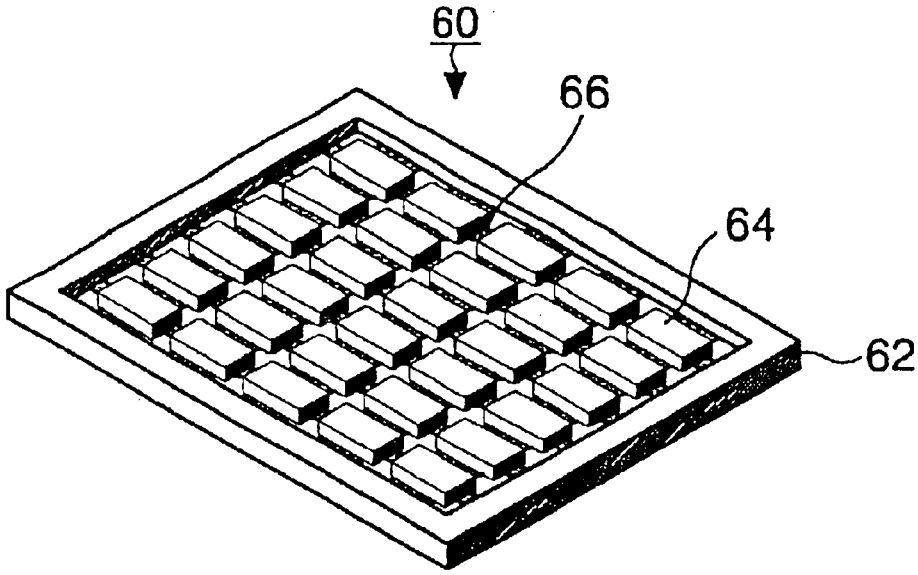
FIG. 8*a* to FIG. 8*b* are perspective views showing the shape of a mold for fabricating the barrier rib in FIG. 6.
Figure 8B:
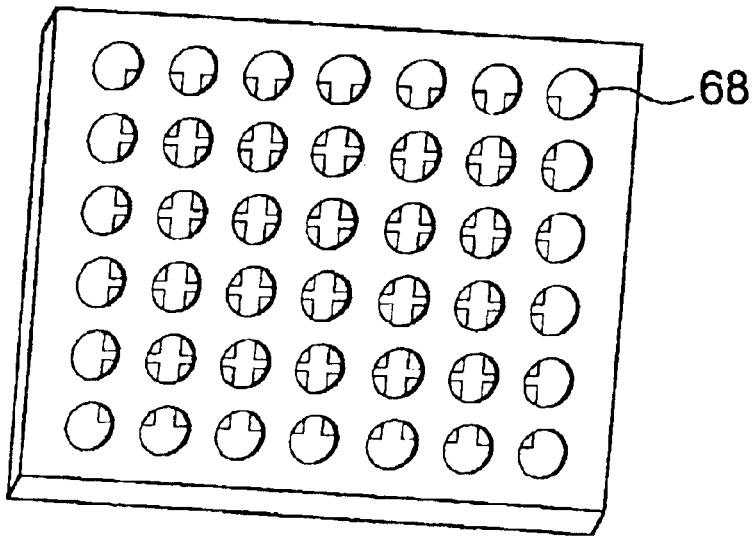

Referring now to FIG. 8*a* and FIG. 8*b*, there is shown a mold 60 for fabricating the barrier rib used at the time of forming the lattice shape of barrier rib 52 shown in FIG. 7. The mold 60 includes a body 62 having plating solution inlets 68 arranged on the upper surface thereof in a matrix pattern, and lattice-shape holes 66 and rectangular protrusions 64 defined at the rear side of the body 62. As shown in FIG. 8*b*, the plating solution inlets 68 are formed in a circular shape in such a manner to correspond with the holes 66 in the body 62 of the mold 60 and arranged in a matrix pattern so as to play a role to paths through which a plating solution inflows at the time of the electro plating. The plating solution inlets 68 are provided on the upper surface of the body 62. If necessary, they may be provided on the side surface of the body 62. The lattice-shape hole 66 is a portion at which the barrier rib 52 is defined, and the protrusion 62 is a portion that corresponds to a discharge space in the picture element unit. In this case, it is possible to form a width of the hole 66 into less than 100 $\mu$m and therefore it is possible to form the barrier rib 52 having a width of less than 100 $\mu$m, so that it can obtain an effect of enlarging a substantial discharge space. The barrier rib 52 can be easily separated from the mold 60 by coating a resin film on the body 62 and the protrusions 64 in the mold and thereafter removing the resin film. Accordingly, as the mold 80 is used a glass or a glass-ceramics material that can be re-used without being influenced by the electro plating. Alternatively, the mold 60 may be made from a sensitive glass, a polymer, a plastic, or their combined material. Such a mold 60 can be manufactured by the mechanical processing method, the etching method, the photolithography method and the laser processing method, etc. The mold 60 shown in FIG. 8*a* and FIG. 8*b* is intended to form the lattice-shape barrier rib 52, but it may form a barrier rib with other appropriate shape, such as a bee hive shape, by changing the structure of the holes 66 and the protrusions 64 in the mold 60. A method of fabricating the barrier rib according to an embodiment of the present invention employing the mold 60 for manufacturing the barrier rib and the electro plating technique will be described below.

Figure 9A:
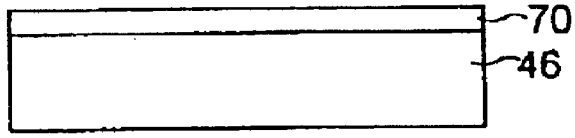
FIG. 9*a* to FIG. 9*d* are sectional views showing a method of fabricating a barrier rib of a PDP according to an embodiment of the present invention.
Figure 9B:
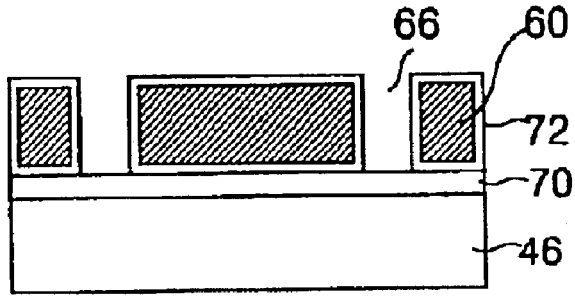

FIG. 9*a* to FIG. 9*d* are sectional views for explaining a method of manufacturing the barrier rib according to an embodiment of the present invention. Referring to FIG. 9*a*, there is shown a metal seed layer 70 disposed on the lower substrate 46. Herein, it is assumed that the address electrode 48 and the lower dielectric layer 50, not shown, has been already formed. The metal seed layer 70 is formed on the lower substrate 46 by means of the non-electrolytic plating, the sputtering and the evaporation, etc. The metal seed layer 70 plays a role to a seed of the barrier rib during the electro plating. FIG. 9*b* shows a barrier rib fabricating mold 60 coated with a resin film 72 attached onto the metal seed layer 70. The mold 60 is prepared separately in the above-mentioned manner, and the resin film 72 for easily separating the barrier rib from the barrier rib fabricating mold 60 after forming the barrier rib is coated and then attached onto the metal seed layer 70. In this case, it is desirable that a contact between the mold 60 and the seed layer 70 be made densely so as to prevent a plating liquid from being penetrated into the interface of the seed layer 70 contacted with the mold 60 to be plated. To this end, a physical force is applied to press the mold 60 into the seed layer 70 or a desired heat is applied to adhere the mold 60 to the seed layer 70. Alternatively, the mold 60 may be adhered to the seed layer 70 by means of a certain adhesive.

Figure 9C:
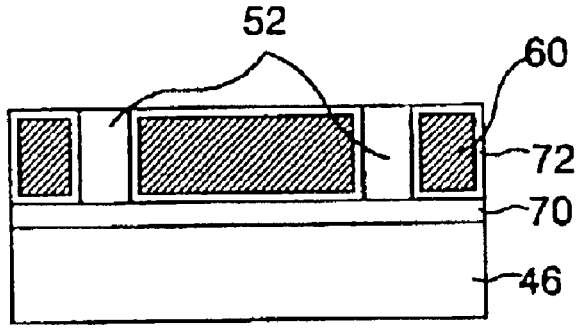

FIG. 9*c* shows the barrier rib 52 formed at the hole 66 provided in the barrier rib fabricating mold 60. The barrier rib 52 is formed using the electro plating. More specifically, in order to perform the electro plating, one side of the electrode provided in an electrolyzer is connected to the metal seed layer 70 while other side of the electrode is connected to a plating material. When a desired voltage is applied to the electrode connected with the metal seed layer 70 and the plating material, the plating material inflows by way of the plating solution inlet 68 defined at the barrier rib fabricating mold 60 while being ionized to grow the plating solution on the metal seed layer 70, thereby forming the barrier rib 52. In this case, as the plating material, that is, a material of the barrier rib 52 is used a metal such as Cu, Ni, Ag, Cr, Zn, Co and Fe, etc., or their alloy of CuZn, CuNi, CrNi, FeZn, NiW and CoW, etc. The barrier rib 52 made from such a metal material has a dense organization to reduce an absorption of the impurity element during the gas discharge and hence enhance the radiation efficiency in comparison to the conventional barrier rib made from the glass-ceramics material. Also, the barrier rib 52 formed of the metal material increases the reflectivity of a visible light to enhance the radiation efficiency in comparison to the conventional barrier rib made from the glass-ceramics material.

Figure 9D:
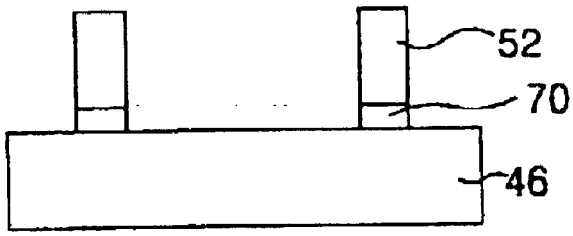

FIG. 9*d* shows a structure in which the barrier rib 52 is formed on the lower substrate 46 by separating the barrier rib fabricating mold 60. The mold 60 is separated from the barrier rib 52 after the resin film 72 is removed using a solvent. Accordingly, a certain gap is provided between the barrier rib 52 formed by the electro plating and the mold 60 to thereby easily separate the mold 60. Then, the metal seed layer 50 exposed by the separation of the mold 60 is removed using the wet etching to thereby complete the barrier rib 52.

If a height of the barrier rib 52 formed in the above-mentioned process is not uniform, then a polishing is appropriately performed to have a uniform height. Also, a chromate treatment by $Cr_2O_3$ is done for the barrier rib 52 made from the metal material using a material such as Cr and the like to express a black color, thereby being available as a black matrix. In this case, the metal barrier rib 52 forms an oxide film by means of the chromate treatment to have an insulting property. If necessary, an insulating layer may be formed on the barrier rib 52 by means of the sol-gel method, the vapor deposition, the PECVD or other appropriate method. As described above, in the method of fabricating the barrier rib according to the present invention, the barrier rib is formed by the simple electro plating technique using the metal material without exploiting various works such as the powder formation, the paste combining, the printing and the high temperature calcining, etc., so that a process can be not only simplified to improve the productivity, but also a waste of the material can be reduced to decrease the manufacturing cost. Also, in the method of fabricating the barrier rib according to the present invention, the metal material is used as a material of the barrier rib to enhance the reflectivity of a visible light and a dense metal barrier rib without an air perforation is formed by the plating technique to minimize an absorption of the impurity element at the time of element fabrication and hence raise the purity of the plasma, thereby improving the radiation efficiency. Further, the metal barrier rib is formed using a mold for fabricating the barrier rib at the time of electro plating so that a good shape of barrier rib having a high aspect ratio can be formed. Accordingly, the barrier rib having a width of less than 100 $\mu$m can be formed to thereby enlarge a substantial discharge space.

Furthermore, in the PDP according to the present invention, a lattice structure of barrier rib is adopted to separate the discharge space into the picture element unit, thereby preventing electrical and optical interference. Also, a lattice structure of barrier rib is employed to increase the coated area of the fluorescent body, thereby enhancing the radiation efficiency. Moreover, the stripes of barrier ribs made from the metal material can be used as the sustaining electrode to reduce the construction elements of the upper plate, thereby improving the light transmissivity.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A mold for fabricating a barrier rib in a plasma display panel, comprising:

a body having a plating solution inlet formed on one side thereof; and a pattern formed on other side of the body to form the barrier rib.

2. The mold in claim 1, wherein the pattern comprises:

a hole in which the barrier rib is formed; and a protrusion corresponding to a discharge space provided by the barrier rib.

3. The mold in claim 1, wherein the plating solution inlet is further formed at the side of the body.

4. The mold in claim 1, wherein a material of the mold includes any one of a glass and a ceramic.

5. The mold in claim 1, wherein a material of the mold includes any one of a sensitive glass, a polymer, a plastic or their complex.

6. The mold in claim 1, wherein the mold is manufactured by employing any one of a mechanical processing technique, an etching technique, an etching technique utilizing the photolithography or a laser processing technique.

7. The mold in claim 1, wherein the mold is coated with a resin film.

8. The mold in claim 1, further comprising:

a lower substrate; and a metal seed layer on said lower substrate facing said pattern, wherein said metal seed layer causes plating material from the plating solution inlet to grow a barrier rib on the metal seed layer.

9. The mold in claim 8, wherein said metal seed layer and said body have different electrical conductivity properties.

10. The mold in claim 8, wherein said body comprises glass or a glass-ceramic material.

11. The mold in claim 8, wherein said metal seed layer comprises metal.

12. The mold in claim 8, wherein said body is adhered to said metal seed layer.

13. The mold in claim 1, further comprising an electrical source opposite said body causing a plating solution to flow in said plating solution inlet onto said pattern to form the barrier rib.

14. A mold for fabricating a barrier rib in a plasma display panel, comprising:

a lower substrate;

a metal seed layer on the lower substrate;

a body formed opposite said lower substrate, wherein said body includes protrusions and depressions on a side facing the lower substrate; and an electrical source, wherein said metal seed layer is connected to said electrical source to grow a plating solution on the metal seed layer.

15. The mold of claim 14, wherein said body further comprises a plating solution inlet.

16. A mold for fabricating a barrier rib in a plasma display panel, comprising:

a substrate;

a seed layer on said substrate;

a plurality of projections on the seed layer; and an electrical source connected to said seed layer, wherein said electrical source is also connected to a plating material causing the plating material to grow on the seed layer between said plurality of protrusions forming said barrier ribs in a plasma display panel.

17. The mold in claim 16, wherein said plating material comprises metal.

18. The mold in claim 16, wherein said seed layer comprises metal.

19. The mold in claim 16, wherein said plurality of projections comprise glass or glass-ceramic.

20. The mold in claim 16, wherein said electrical source comprises an electrolyzer.

* * * * *